US010894264B2

(12) United States Patent
Salciarini et al.

(10) Patent No.: US 10,894,264 B2
(45) Date of Patent: Jan. 19, 2021

(54) FILLING SYSTEM COMPRISING A BOTTLE TO BE FILLED WITH A LIQUID AND A FILLING MODULE

(71) Applicant: CHANEL PARFUMS BEAUTE, Neuilly sur Seine (FR)

(72) Inventors: Christian Salciarini, Hyeres (FR); Julien Chandelier, Verrieres le Buisson (FR); Grégory Perbal, Verrieres le Buisson (FR)

(73) Assignee: CHANEL PARFUMS BEAUTE, Neuilly sur Seine (FR)

( * ) Notice: Subject to any disclaimer, the term of this patent is extended or adjusted under 35 U.S.C. 154(b) by 295 days.

(21) Appl. No.: 15/758,784

(22) PCT Filed: Sep. 30, 2016

(86) PCT No.: PCT/EP2016/073477
§ 371 (c)(1),
(2) Date: Mar. 9, 2018

(87) PCT Pub. No.: WO2017/060174
PCT Pub. Date: Apr. 13, 2017

(65) Prior Publication Data

US 2019/0047003 A1 Feb. 14, 2019

(30) Foreign Application Priority Data

Oct. 5, 2015 (FR) ..... 15 59442

(51) Int. Cl.
*B05B 11/00* (2006.01)
*A45D 34/02* (2006.01)
*B67D 7/02* (2010.01)

(52) U.S. Cl.
CPC ..... *B05B 11/0056* (2013.01); *A45D 34/02* (2013.01); *B05B 11/0044* (2018.08); *B05B 11/3001* (2013.01); *B67D 7/0294* (2013.01)

(58) Field of Classification Search
USPC ..... 141/113, 318, 346, 347, 351, 369
See application file for complete search history.

(56) References Cited

U.S. PATENT DOCUMENTS

2011/0056993 A1* 3/2011 Lee ..... A61L 2/238 222/256
2012/0158193 A1* 6/2012 De Rosa ..... A47K 5/1217 700/283

(Continued)

FOREIGN PATENT DOCUMENTS

EP 2 383 204 A1 11/2011
FR 2 802 447 A1 6/2001

(Continued)

OTHER PUBLICATIONS

Feb. 13, 2017 Search Report issued in International Patent Application No. PCT/EP2016/073477.

*Primary Examiner* — Daphne M Barry
(74) *Attorney, Agent, or Firm* — Oliff PLC; R. Brian Drozd

(57) ABSTRACT

A filling system including: a bottle having a hollow enclosure with a base; a filling module that includes a reservoir; a plate able to move between a high position and a low position; a pump; a compression system configured so as to compress the pump when the plate descends; a pipe assembly between the reservoir and the plate and the pump; and a connection assembly for fluid between the plate and the base.

9 Claims, 7 Drawing Sheets

(56) References Cited

U.S. PATENT DOCUMENTS

Figure 2:
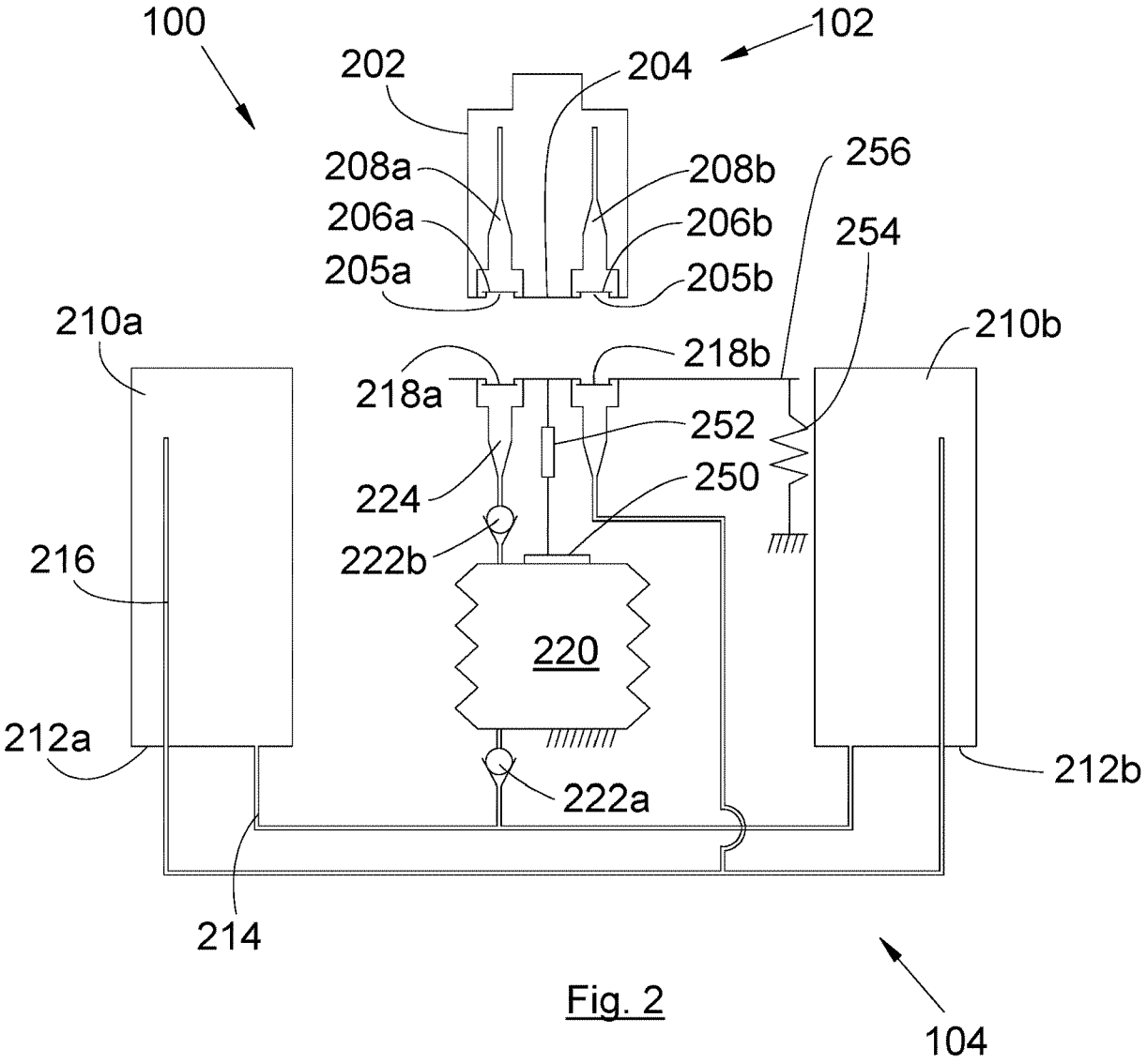

| | | | |
|---|---|---|---|
| 2013/0019992 | A1 | 1/2013 | Feriani et al. |
| 2014/0041753 | A1 | 2/2014 | Beranger et al. |

FOREIGN PATENT DOCUMENTS

| | | | |
|---|---|---|---|
| FR | 2 966 129 | A1 | 4/2012 |
| JP | H06-54579 | U | 7/1994 |
| WO | 2004/092016 | A1 | 10/2004 |

* cited by examiner

FILLING SYSTEM COMPRISING A BOTTLE TO BE FILLED WITH A LIQUID AND A FILLING MODULE

The present invention relates to a filling system comprising a bottle to be filled with a liquid and a filling module comprising at least one reservoir containing said liquid.

A perfume bottle contains a limited quantity of perfume and, when the bottle is empty, the user must buy another bottle in order to be able to perfume herself. To limit waste, filling the bottle once again with perfume from a reservoir previously filled with said perfume is known.

In order to fill the bottle, various methods are used. The method is known that consists of opening the bottle, for example at its diffuser, pouring perfume therein and closing it again. Such a method may cause a loss of seal at the diffuser and therefore a leakage of perfume.

There exist systems where the bottle may be filled by a direct connection with a feed bottle. The documents EP-A-2 383 204 or FR-A-2 966 129 for example describe such devices. However, they are complex to use. It is in fact necessary to partially dismantle the feed bottle, the positioning and alignment of the two bottles must be precise, and there are risks of leakage.

One object of the present invention is to propose a filling system that does not have the drawbacks of the prior art and in particular ensures a good seal of the bottle and the filling of which consists of a simple operation that is natural for the user.

To this end, a filling system is proposed comprising:

- a bottle having a hollow enclosure with a base pierced with two holes,
- a filling module comprising:
  - a reservoir having a bottom,
  - a plate able to be moved in translation vertically between a high position and a low position and having a location for accommodating the base,
  - a pump in the form of a flexible enclosure,
  - a compression system configured so as to compress the pump when the plate passes from the high position to the low position,
  - a return means that constrains the plate in the high position, and
  - a pipe assembly between the reservoir and the plate on the one hand and between the reservoir and the pump on the other hand, and
- a connection assembly for a fluid between the plate and the base and which comprises:
  - for each hole, a valve housed in said hole, extended in the bottle by a pipe and able to move between a closed position and an open position,
  - a first valve and a second valve both fixed to the plate, able to move between a closed position and an open position, the first valve being designed to cooperate with one of the valves and the second valve being designed to cooperate with the other valve, the second valve being connected to one of the pipes of said set of pipes,
- where said pipe assembly comprises:
  - a first pipe emerging in the reservoir at the bottom,
  - a second pipe emerging in the reservoir at a distance from the bottom and connected to the second valve,
  - a first non-return valve between the first pipe and the pump and allowing the liquid to pass from the first pipe to the pump,
  - a connecting pipe extending the first valve,

- a second non-return valve between the connecting pipe and the pump, and allowing the liquid to pass from the pump to the connecting pipe, and
  - an opening/closing mechanism configured so as to simultaneously open the valves when the first valve is in contact with one of the valves and the second valve is in contact with the other valve, and to simultaneously close the valves when they are not in contact,
- and where the filling module comprises a base consisting of a platen and a sub-platen fixed to one another and between which part of the second pipe is implemented by means of recesses, the plate comprises a top plate and an underplate fixed to one another and between which part of the second pipe is implemented by means of recesses, and the second pipe has an intermediate part that extends between the plate and the base, and the intermediate part takes the form of a bellows tube.

Advantageously, the ends of the two pipes that emerge in the bottle are at the same height in the bottle.

Advantageously, the first pipe emerges in the reservoir flush with respect to the bottom.

Advantageously, each valve of the bottle has a seat and an obturator, the seat is mounted on a spring and able to move vertically between a lowered position and a raised position, the obturator is fixed and has a splayed part oriented towards the plate, the first and second valves each have a seat and an obturator, the obturator has a splayed part oriented towards the bottle, the obturator is mounted on a spring and able to move vertically between a raised position and a lowered position, and the seat is fixed.

Advantageously, the return means consists of a compression spring housed in the pump.

Advantageously, the filling means has a casing pierced with a window above the first and second valves, a flap mounted on the casing and able to move between a closed position in which the flap closes off the window and an open position in which the flap does not close off the window, and a return means that constrains the flap in the closed position.

Advantageously, the plate has at least one magnet and the base of the bottle has, for the or each magnet, a counter-magnet of opposite polarity.

Advantageously, the filling module has a locking system that can alternately adopt a locking position that locks the plate in the low position or a released position in which the plate can rejoin the high position.

Figure 1:
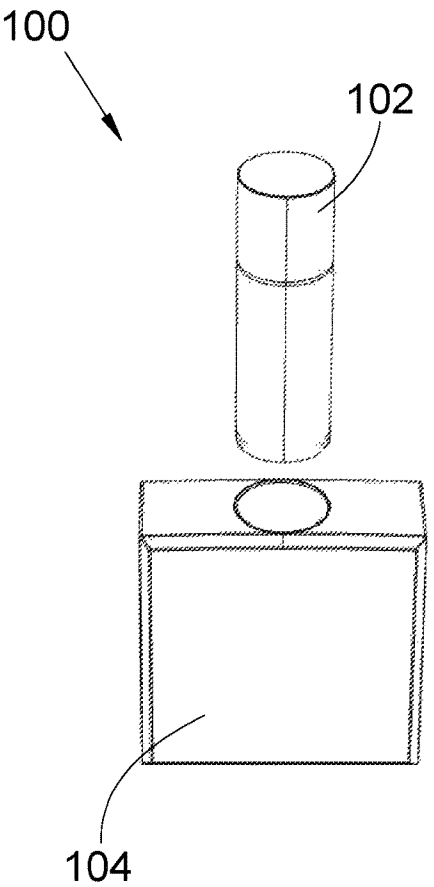
Figure 4:
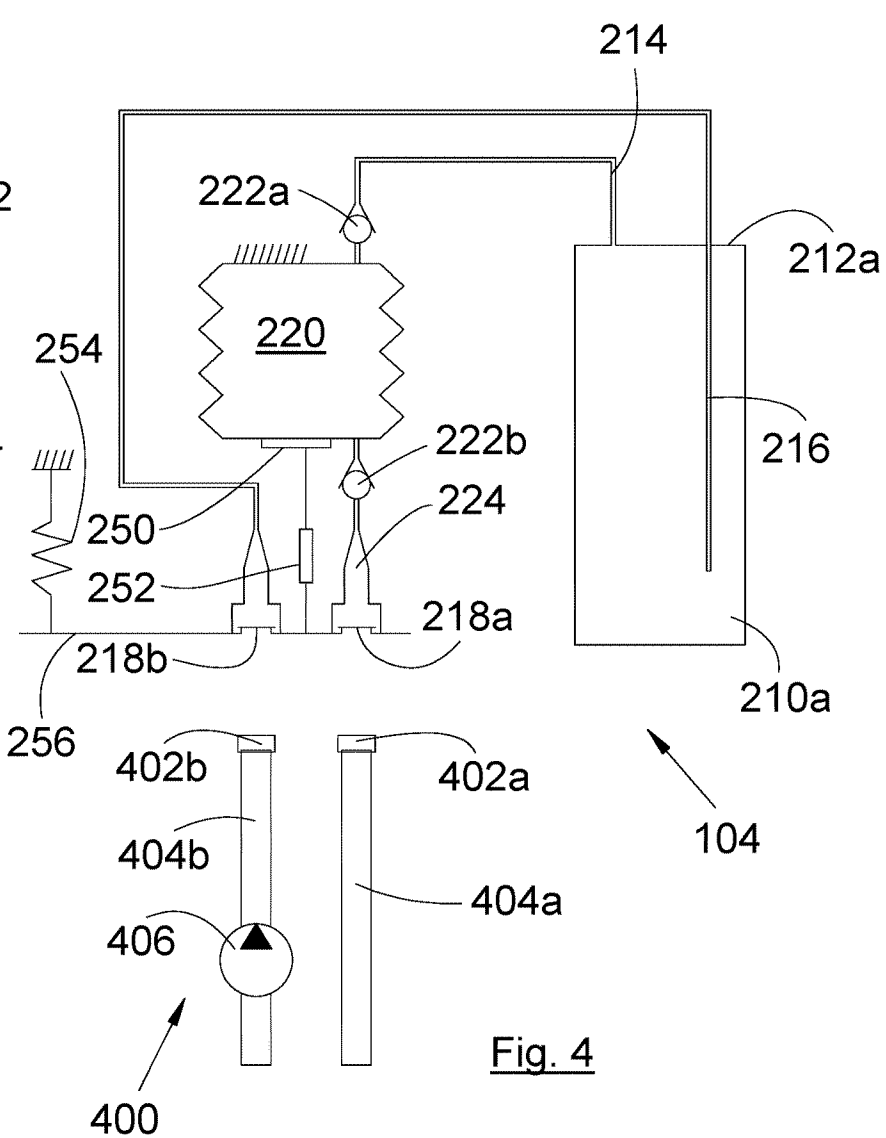
Figure 3:
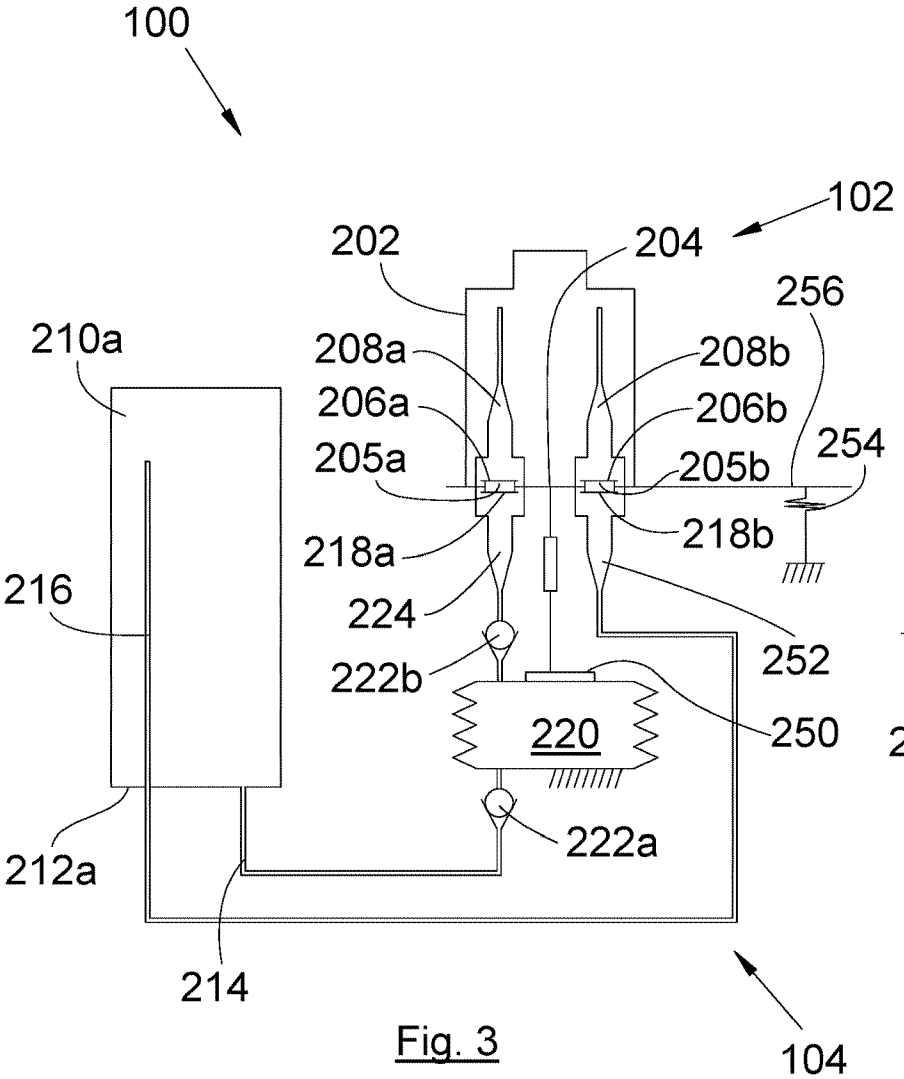
Figure 13:
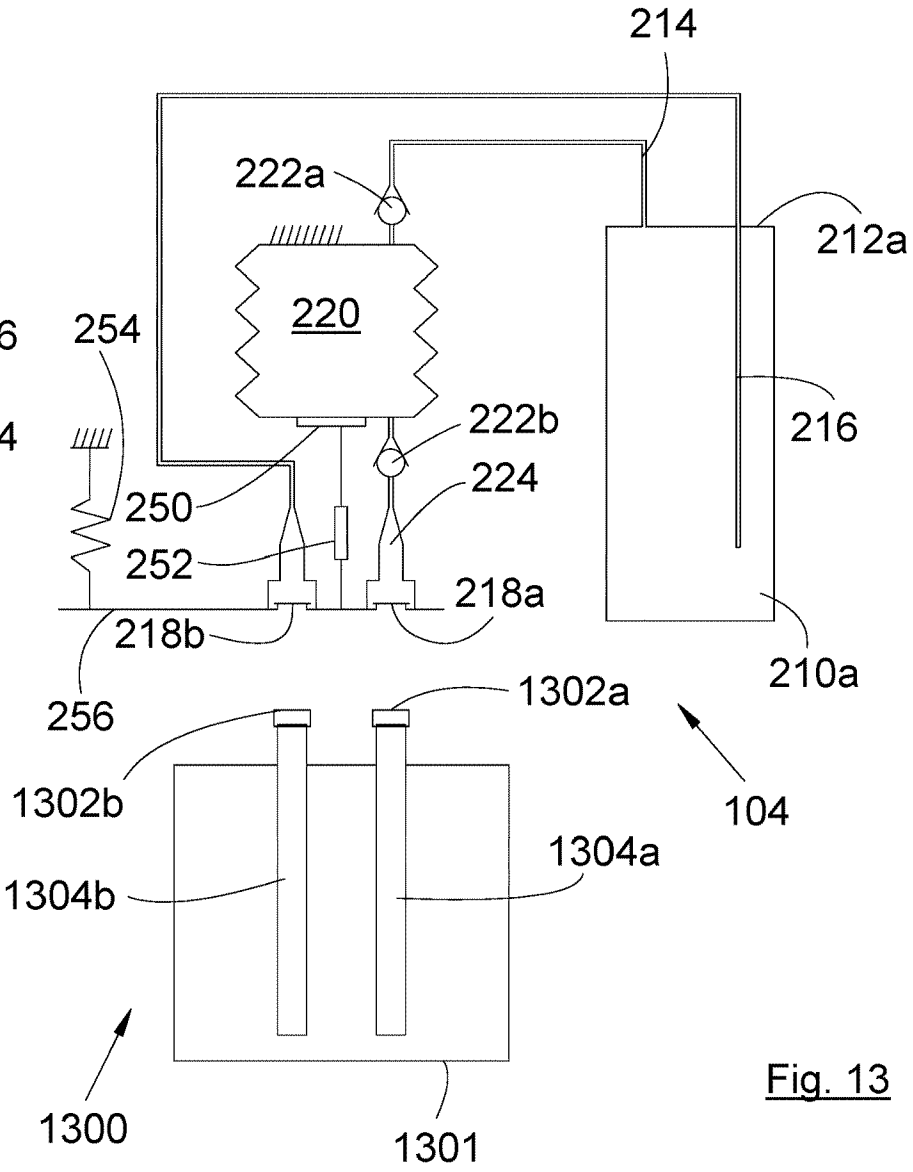
Figure 5:
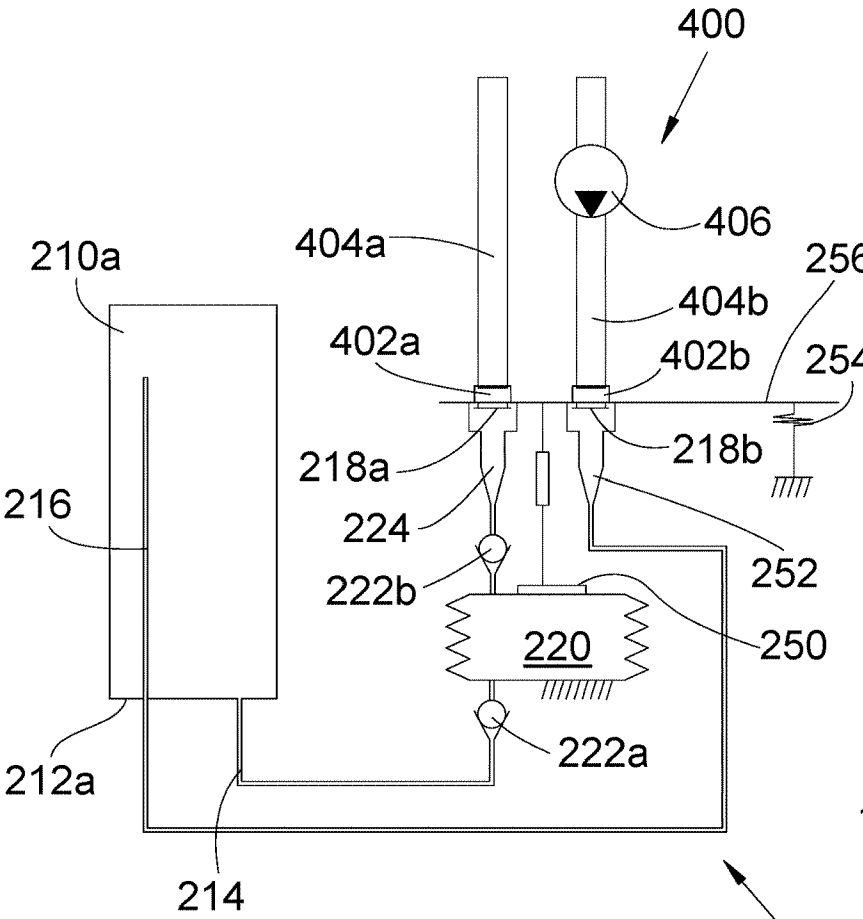
Figure 7:
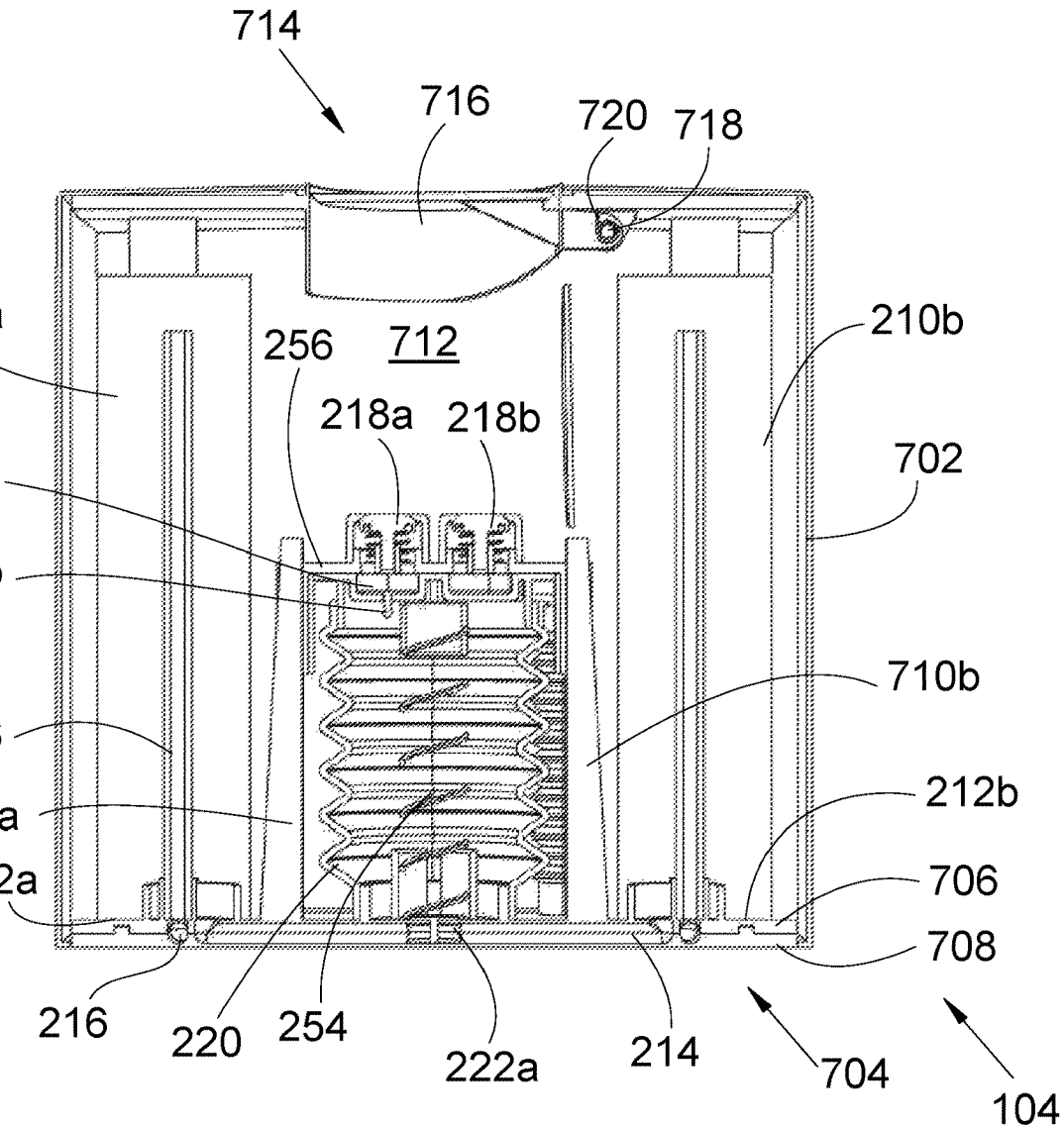
Figure 6:
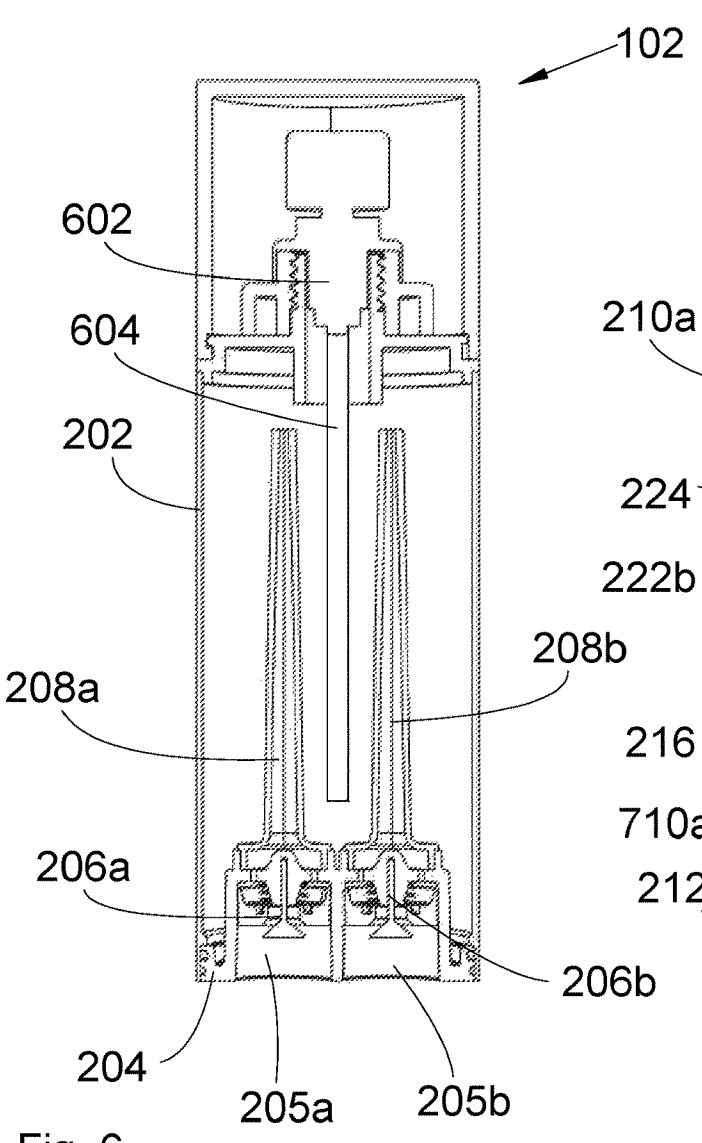
Figure 9:
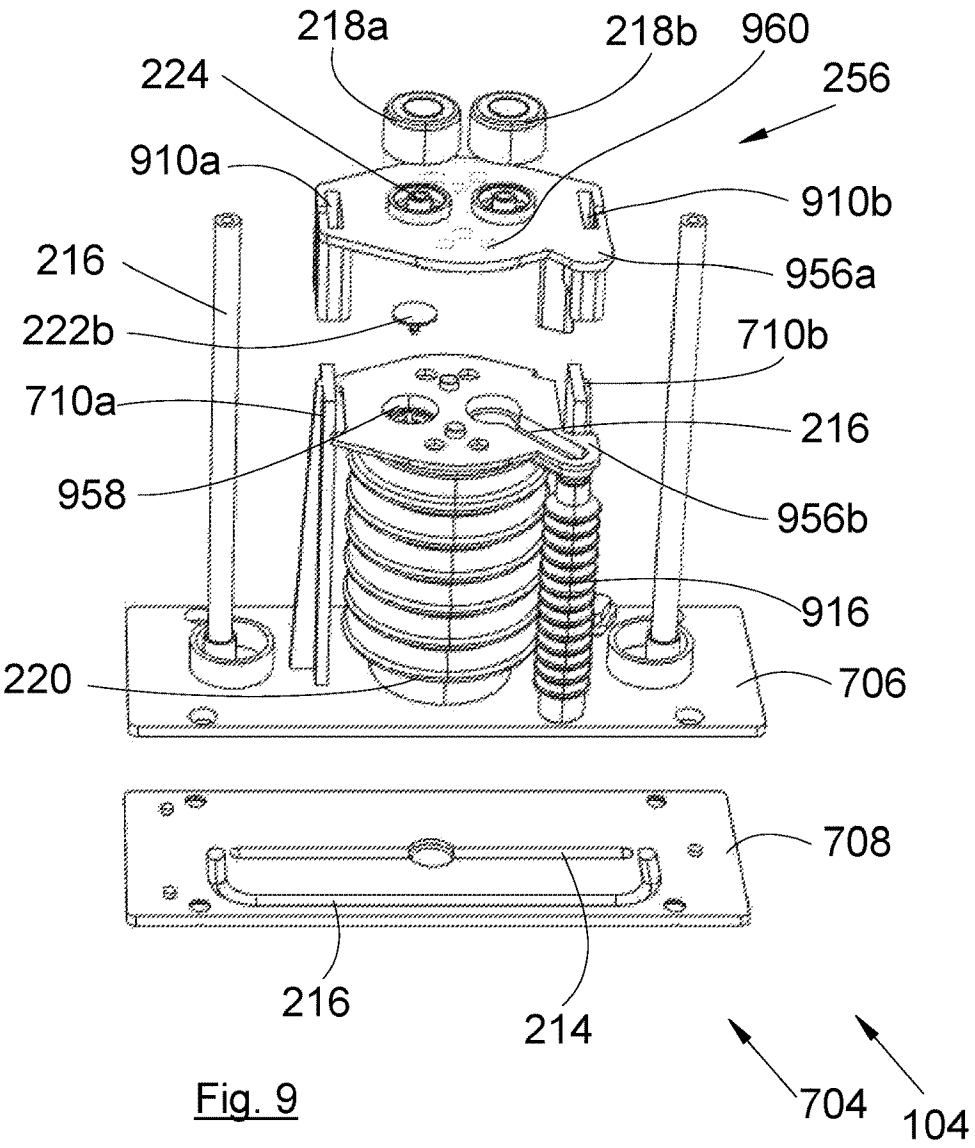
Figure 8:
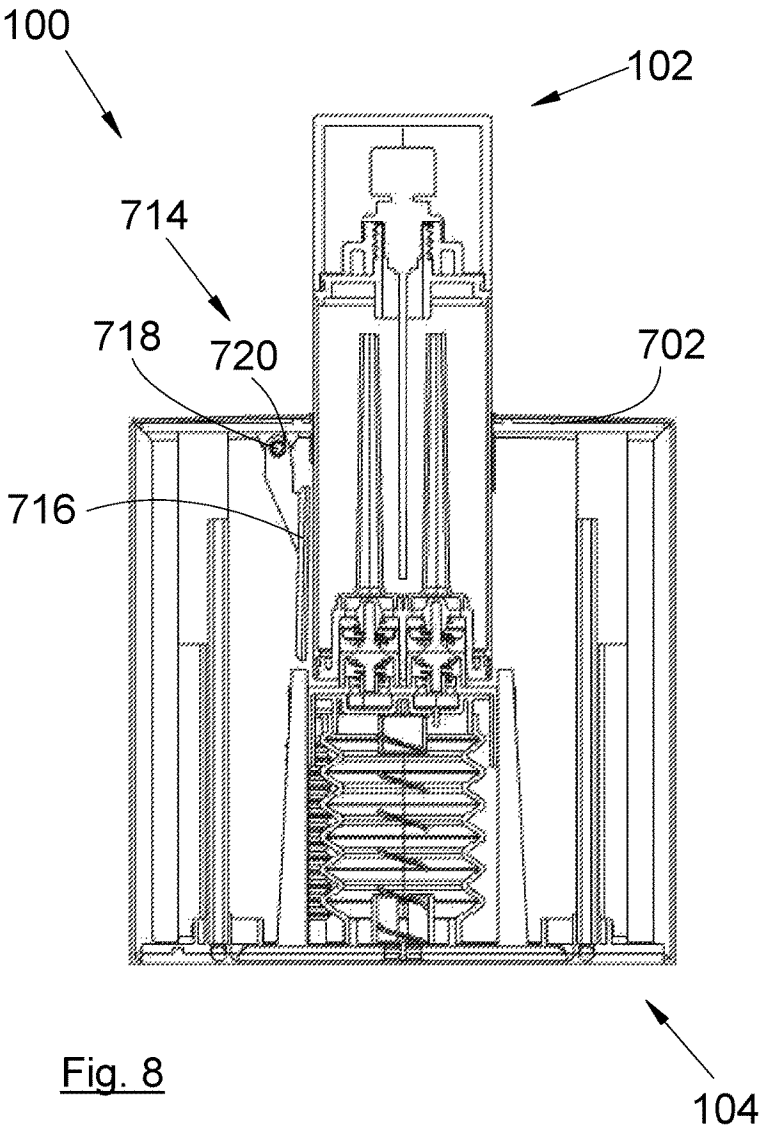
Figure 10:
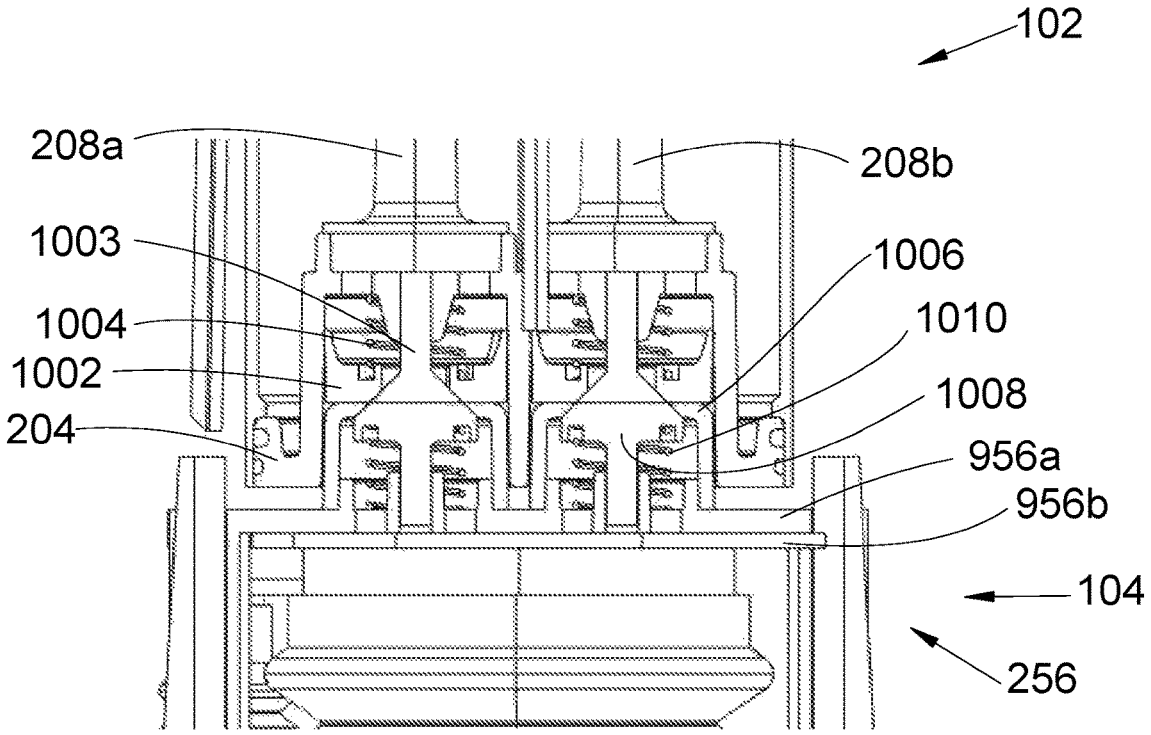
Figure 11:
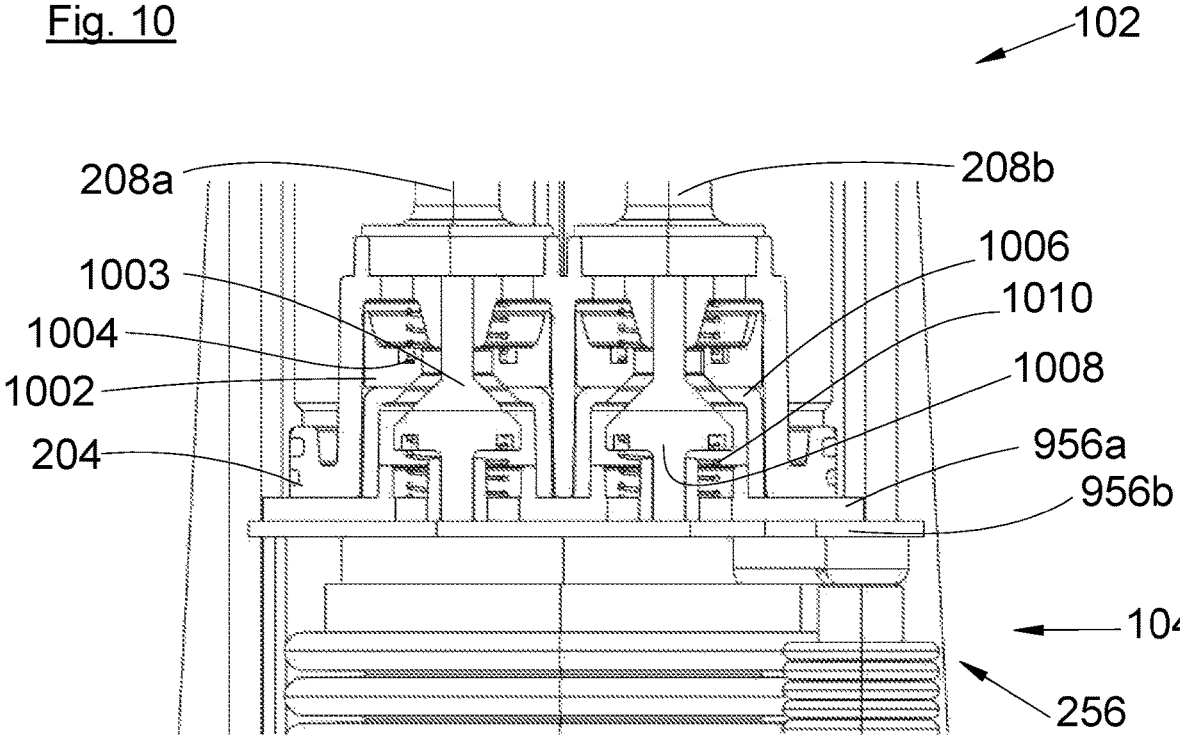
Figure 12:
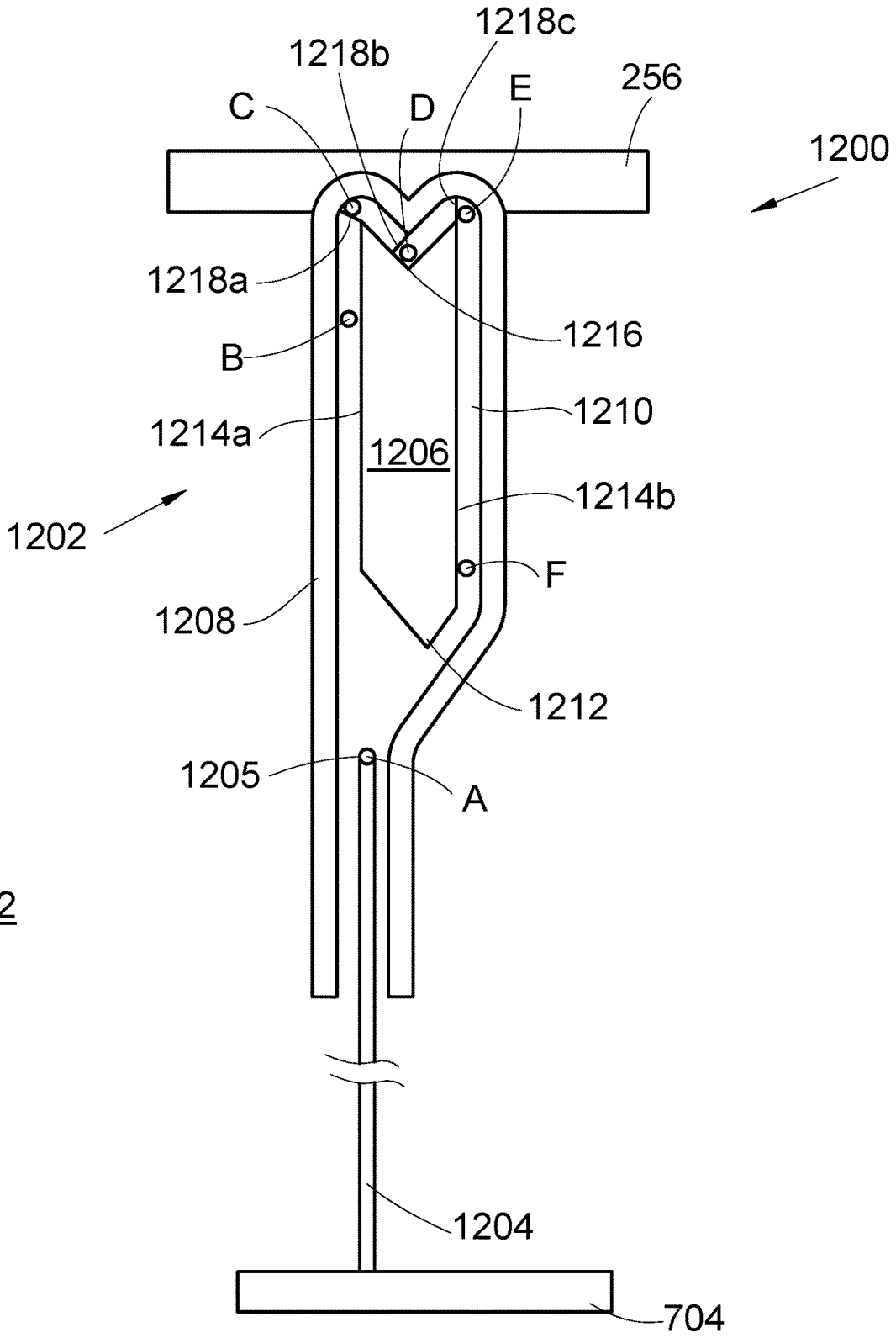

The features of the invention mentioned above, as well as others, will emerge more clearly from a reading of the following description of an example embodiment, said description being given in relation to the accompanying drawings, among which:

FIG. 1 is a perspective view of a filling system according to the invention, FIG. 2 is a schematic representation of the filling system in a starting position, FIG. 3 is a schematic representation of the filling system in a pumping position, FIG. 4 is a schematic representation of the filling system in a position of filling the reservoir in the factory, FIG. 5 is a schematic representation of the filling system in a position of priming the pump, FIG. 6 is a view in cross section of a bottle of the filling system, FIG. 7 is a view in cross section of a filling module of the filling system, FIG. 8 is a view in cross section of the filling system, FIG. 9 is an exploded view of the filling module, FIG. 10 is a detail view of the connections between the bottle and the filling module in the starting position, FIG. 11 is a detail view of the connections between the bottle and the filling module in the pumping position, FIG. 12 is a view of a detail of the filling module, and FIG. 13 is a schematic representation of the filling system in a position of filling the reservoir from a make-up reservoir.

In the following description, the terms relating to a position are taken with reference to a filling system disposed vertically, that is to say as shown in FIG. 1.

FIG. 1 shows a filling system 100 that comprises a bottle 102, for example of the perfume bottle type, and a filling module 104. In a known fashion, the perfume bottle 102 has a receptacle with a narrow neck surmounted by a diffuser comprising a dispensing pump and a push button. The pump is of the air take-up type, that is to say it enables air to enter the receptacle in order to compensate for the drop in level of the liquid. Also it has a plunger tube. Preferably a cap covers the receptacle and the diffuser when the bottle is not being used.

The filling module 104 comprises at least one reservoir filled with liquid, in particular perfume, and a mechanism for filling the bottle 102 with the liquid contained in the reservoir or reservoirs.

FIG. 2 shows the hydraulic diagram of the filling system 100.

The bottle 102 comprises a hollow enclosure 202 having a base 204 pierced with two holes 205*a-b*, each of the holes 205*a-b* being closed by a valve 206*a-b*. Each valve 206*a-b* is extended by a pipe 208*a-b* that extends in the internal volume of the enclosure 202. Each pipe 208*a-b* here extends perpendicular to the base 204 and emerges in the enclosure 202 at a distance from the base 204.

As described below, each valve 206*a-b* is able to move between a closed position in which no fluid (liquid or air) can pass through the hole 205*a-b* and an open position in which a fluid (liquid or air) can pass through the hole 205*a-b*. Each valve 206*a-b* is configured so that, in the open position, a fluid (liquid or air) can pass through the hole 205*a-b* and flow in the pipe 208*a-b*, or flow from the pipe 208*a-b* to the hole 205*a-b*.

The filling module 104 comprises at least one reservoir 210*a-b* having a bottom 212*a-b*. In the following description, the filling module 104 is described on the basis of a single reservoir 210*a*, knowing that any additional reservoir 210*b* is connected in the same way. The reservoir 210*a* is produced from any suitable material, rigid or flexible.

The filling module 104 comprises a first pipe 214 that emerges in the reservoir 210*a* at the bottom 212*a*, and a second pipe 216 that emerges in the reservoir 210*a* at a distance from the bottom 212*a*. The reservoir 210*a* is impervious, that is to say, apart from the two pipes 214 and 216, it has no other communication with the outside.

The filling module 104 also comprises a first valve 218*a* and a second valve 218*b* that are also each able to move between a closed position in which no fluid (liquid or air) can pass through the valve 218*a-b* and an open position in which a fluid (liquid or air) can pass through the valve 218*a-b*. The first valve 218*a* and the second valve 218*b* are oriented upwards.

The second valve 218*b* is extended by a second pipe 216 and is configured so that, in the open position, a fluid (liquid or air) can flow through the second valve 218*b* into the second pipe 216, or flow from the second pipe 216 to the second valve 218*b*.

The filling module 104 also comprises a pump 220 in the form of a flexible enclosure, for example a bellows pump.

The first pipe 214 emerges in the pump 220 through a first non-return valve 222*a* allowing the liquid to pass from the first pipe 214 to the pump 220.

The first valve 218*a* is extended by a connecting pipe 224 and the first valve 218*a* is configured so that, in the open position, a liquid can flow through the first valve 218*a* into the connecting pipe 224, or flow from the connecting pipe 224 to the first valve 218*a*.

The connecting pipe 224 emerges in the pump 220 through a second non-return valve 222*b* allowing the liquid to pass from the pump 220 to the connecting pipe 224.

FIG. 2 shows the filling system 100 when the bottle 102 is at a distance from the filling module 104. As shown in FIG. 3, when the bottle 102 is brought close to the filling module 104, one of the valves 206*a* of the bottle 102 cooperates with the first valve 218*a* and the other valve 206*b* of the bottle 102 cooperates with the second valve 218*b*, and a suitable opening/closing mechanism, one embodiment of which is described below, simultaneously opens the valves 205*a-b* and 2018*a-b*. Conversely, when the bottle 102 is moved away from the filling module 104, the opening/closing mechanism simultaneously closes the valves 205*a-b* and 2018*a-b*. The opening/closing mechanism is thus configured to simultaneously open the valves 205*a-b* and 2018*a-b* when the first valve 218*a* is in contact with one of the valves 206*a* and the second valve 218*b* is in contact with the other valve 206*b*, and to simultaneously close the valves 205*a-b* and 2018*a-b* when they are no longer in contact.

The first and second valves 218*a-b* are fixed to a plate 256 of the filling module 104 that is able to move in translation vertically (252) between a high position (FIG. 2) and a low position (FIG. 3) and has a location for accommodating the base 204 of the bottle 102.

The filling module 104 also comprises a compression system 250 that is designed to compress the pump 220 when the plate 256 passes from the high position to the low position by placing the bottle 102 on the location and pressing the bottle 102 on the plate 256. In FIG. 2, the compression system 250 takes the form of a horizontal wall secured to the plate 256, which moves with it and compresses the pump 220.

The filling module 104 also comprises a return means 254, such as for example a compression spring, which constrains the plate 256 in the high position.

The filling of the bottle 102 will now be described from FIGS. 2 and 3, from an initial position in which the reservoir 210*a* and the pump 220 are filled with liquid.

The bottle 102 is brought to the plate 256, which is in the high position (FIG. 2), so that one of the valves 206*a* of the bottle 102 comes opposite the first valve 218*a* and so that the other valve 206*b* of the bottle 102 comes opposite the second valve 218*b*. The opening/closing mechanism simultaneously opens the valves 205*a-b* and 218*a-b* in order thus to create fluid continuity between firstly a pipe 208*a* of the bottle 202 and the connecting pipe 224, and through the latter the pump 220 and the first pipe 214, and secondly the other pipe 208*b* of the bottle 202 and the second pipe 216.

The continuous abutment of the bottle 102 on the plate 256 tends to make the plate 256 pass into the low position (FIG. 3), causing the movement of the compression system 250, which compresses the pump 220. This compression of the pump 220 expels the liquid that it contains through the second non-return valve 222*b*, and then through the first valve 218*a*, the facing valve 206*a* and finally the pipe 208*a*, and the liquid spurts into the bottle 102. At the same time, because of the arrival of the liquid, the air contained in the bottle 102 is expelled through the other pipe 208*b*, and then the facing valve 206*b*, the second valve 218*b* and finally the second pipe 216, and arrives in the reservoir 210*a*.

Thus the liquid fills the bottle 102 and the air is expelled therefrom to the reservoir 210*a*, where it compensates for the loss of liquid.

The operation can be repeated, that is to say it is possible to activate the pump 220 several times by lowering and raising the bottle 102.

When the bottle 102 is raised or is removed, the return means 254 forces the plate 256 to rise to the high position (FIG. 2). The pump 220 then inflates again by aspirating the liquid coming from the reservoir 210*a* and passing through the first pipe 214 and the first non-return valve 222*a*. When the bottle 102 moves away from the filling module 104, the opening/closing mechanism simultaneously closes the valves 205*a-b* and 218*a-b* so as to prevent any leakage of liquid. The pump 220 is then once again filled with liquid and the filling of a new bottle 102 can begin.

More generally, the filling system 100 comprises:

the bottle 102 having the enclosure 202 with the base 204, the filling module 104 comprising:

- the reservoir 210*a-b*,
- the plate 256 able to move in translation vertically 252 between the high position and the low position and having the location for accommodating the base 204,
- the pump 220 in the form of a flexible enclosure,
- the compression system 250 configured so as to compress the pump 220 when the plate 256 passes from the high position to the low position,
- a return means 254 that constrains the plate 256 in the high position,
- a set of pipes 214, 216, 224 between the reservoir 210*a-b* and the plate 256 on the one hand and between the reservoir 210*a-b* and the pump 220 on the other hand, and the connection assembly for a fluid 218*a-b*, 206*a-b* between the plate 256 and the base 204.

Such a filling system 100 is therefore easy to use since it suffices to bring the bottle 102 to the filling module 104 and to press thereon in order to activate the pump 220 and, since no part of the bottle 102 is removable, there is no risk of leakage.

When the liquid in the bottle 102 reaches the opening of the pipe 208*b* serving for discharging air during filling, the liquid overflow takes the path of the air and returns into the reservoir 210*a*, thus preventing excessive filling of the bottle 102 and a loss of liquid.

The connection assembly for fluid comprises:

for each hole 205*a-b*, the valve 206*a-b* housed in said hole 205*a-b*, the first valve 218*a* and the second valve 218*b* both connected to one of the pipes 216 of said pipe assembly.

The pipe assembly comprises:

the first pipe 214, the second pipe 216 connected to the second valve 218*b*, the first non-return valve 222*a*, the connecting pipe 224, the second non-return valve 222*b*, and the opening/closing mechanism.

In order to be able to use the filling module 104, it is necessary for the reservoir 210*a* to be filled. FIG. 4 shows the principle of filling the reservoir 210*a* in the factory.

The filling module 106 is turned over so as to present the first and second valves 218*a-b* oriented downwards. A double connector 400 having a first connector 402*a* and a second connector 402*b* is brought to the first and second valves 218*a-b*. The first connector 402*a* is connected to the first valve 218*a* and the second connector 402*b* is connected to the second valve 218*b*, this double connection causes the opening of the first and second valves 218*a-b*.

The first connector 402*a* is extended by a first tube 404*a* and second connector 402*b* is extended by second tube 404*b*, to which there is connected a filling pump 406 connected to a liquid-storage reservoir.

When the filling pump 406 is started up, the liquid is sent through the second tube 404*b*, then the second valve 218*b* and then the second pipe 216, and then flows into the reservoir 210*a* through the second pipe 216 in order to fill it while the air is expelled therefrom through the first pipe 214, the pump 220, the first valve 218*a* and the first tube 404*a*.

When the liquid reaches the bottom 212*a* (which is here at the top), it flows through the first pipe 214 and the first non-return valve 222*a* in order to flow into the pump 220 and then through the non-return valve 222*b*, to the connecting pipe 224, the first valve 218*a*, and finally the first connector 402*a* and the first tube 404*a*.

At the end of these steps, the reservoir 210*a* is filled but the pump 220 is empty.

FIG. 5 shows a step of priming the pump 220. The assembly in FIG. 4 is turned over and liquid is sent by the filling pump 406 into the second valve 218*b*, as before, the liquid goes into the reservoir 210*a* through the second pipe 216. The overflow then flows through the first pipe 214 and goes into the pump 220.

The air contained in the pump 220 is then discharged by a succession of movements of the plate 256 from the high position to the low position, and returns to the high position.

In order to be able to use the filling module 104 a plurality of times, it is possible to make provision for the reservoir 210*a* to be filled once again. FIG. 13 shows the principle of filling the reservoir 210*a* from a reserve reservoir 1300.

The general principle is identical to that of a filling in the factory.

The filling module 104 is turned over so as to present the first and second valves 218*a-b* oriented downwards. The reserve reservoir 1300 has a first connector 1302*a* and a second connector 1302*b* which are brought respectively to the first and second valves 218*a-b*. The first connector 1302*a* is connected to the first valve 218*a* and the second connector 1302*b* is connected to the second valve 218*b*, this double connection causes the opening of the first and second valves 218*a-b*.

The reserve reservoir 1300 also comprises a hollow shell 1301 in which the liquid is stored.

The first connector 1302*a* is extended by a first tube 1304*a* and the second connector 1302*b* is extended by a second tube 1304*b*. The two tubes 1304*a-b* are housed in the shell 1301 and are immersed in the liquid.

After the connectors 1302*a-b* and valves 218*a-b* are connected, pressing on the plate 256 causes the compression of the pump 220, the air of which empties through the second non-return valve 222*b*, the connecting pipe 224, the first valve 218*a* and finally the first connector 1302*a* and the first tube 1304*a* in order to arrive in the shell 1301. Releasing the filling module 104 causes, under the action of the return means 254, the inflation of the pump 220, which aspirates the air from the reservoir 210*a* through the first pipe 214 and the first non-return valve 222*a*. This transfer of air causes a negative pressure in the reservoir 210*a*. Because of this negative pressure, the liquid contained in the shell 1301 is aspirated by the second tube 1304*b*, through the first pipe 214, and fills the reservoir 210*a*.

When the reservoir 210*a* is full, continuing the actuations of the pump 220 causes circulation of liquid between the reservoir 210*a* and the bottle 102.

So that the valves 206*a-b* of the bottle 102 can be positioned in any way on the filling module 104, the ends of the two pipes 208*a-b* that emerge in the bottle 102 are at the same height in the bottle 102.

So that the reservoir 210*a* can empty entirely without leaving any liquid in the bottom, the first pipe 214 emerges in the reservoir 210*a* flush with respect to the bottom 212*a*.

FIG. 6 shows the bottle 102 according to a particular embodiment of the invention. The base 204, which is secured to the enclosure 202, has the two holes 205*a-b* closed off by the valves 206*a-b*, which are shown here in the open position and are extended by the pipes 208*a-b*. At the top part, the bottle 102 has a diffuser 602 associated with a plunger tube 604 that makes it possible to vaporize liquid.

FIG. 7 shows the filling module 104 according to a particular embodiment of the invention. The filling module 104 has a casing 702 that encloses the elements that constitute the filling module 104. The bottom part of the plate 256 constitutes here the compression system 250.

The casing 702 has a base 704 consisting of a platen 706 and a sub-platen 708 that are fixed to one another and between which, by means of recesses, the first pipe 214 and a part of the second pipe 216 are implemented, which provides a saving in space and simplicity of implementation.

In the embodiment of the invention in FIG. 7, the return means 254 consists of a compression spring housed in the pump 220 in the form of a bellows pump 220. Such an assembly affords a saving in space.

The guidance of the plate 256 is achieved here by vertical guides 710*a-b* that form ribs and through the presence of grooves 910*a-b* (FIG. 9) that the plate 256 has and which cooperate with the vertical guides 710*a-b*.

The casing 702 has a housing 712 designed to receive the bottom part of the bottle 102 during filling. The entry of the bottle 102 in the housing 712 is provided by the presence of a window 714 at the top part of the casing 702 above the first and second valves 218*a-b*. To prevent objects falling into the filling module 104 when the bottle 102 is not present in the housing, the filling module 104 has a flap 716 that closes off the window 714 when the bottle 102 is absent and which retracts inside the casing 702 when the bottle 102 enters the housing 712. The flap 716 is here mounted between a closed position in which the flap 716 closes off the window 714 and an open position where the flap 716 does not close off the window 714. The movement of the flap 716 is here a rotation about a horizontal rotation axis 718. To constrain the flap 716 in the closed position, the filling module 104 has a return means 720, here in the form of a torsion spring.

FIG. 8 shows the bottle 102 in the casing 402 and the retraction of the flap 716.

FIG. 9 shows an exploded view of the filling module 104.

The plate 256 consists of a top plate 956*a* carrying the grooves 910*a-b* and a sub-plate 956*b*.

The sub-platen 956*b* has an orifice 958 providing fluid continuity with the pump 220 and against which the second non-return valve 222*b* is disposed. The sub-plate 956*b* and the top plate 956*a* are fixed to one another, and part of the second pipe 216 is implemented between them by recesses.

The top plate 956*a* is also pierced with two orifices providing fluid continuity firstly between the second non-return valve 222*b* and the first valve 218*a* and secondly between the second pipe 216 and the second valve 218*b*.

The second pipe 216 also has an intermediate part 916 that extends between the plate 256 and the base 704. Since the plate 256 moves vertically, this intermediate part 916 moves and, in order to limit the space requirement and to facilitate this movement, the intermediate part 916 takes the form of a bellows tube.

To facilitate the placing of the bottle 102 on the plate 256 and to ensure holding of the bottle 102 against the plate 256, the latter has at least one magnet 960 and the base 204 of the bottle 102 has, for the or each magnet 960, a counter-magnet of opposite polarity. The magnets 960 and the counter-magnets are positioned so as to be facing each other when the valves 218*a-b* and 205*a-b* are aligned. This system of attachment with magnets is however optional. It would also be possible to achieve attachment with other systems, for example a quarter turn or bayonet type.

FIG. 10 and FIG. 11 show a particular embodiment of the valves 218*a-b* and 205*a-b* in the closed position for FIG. 10 and in the open position for FIG. 11.

The valves 205*a-b* of the bottle 102 each have a seat 1002 and an obturator 1003. The seat 1002 is mounted on a spring 1004 and is able to move vertically between a lowered position (FIG. 10) and a raised position (FIG. 11). The spring 1004 constrains the seat 1002 in the lowered position. The obturator 1003 is fixed and has a splayed part oriented towards the plate 256, and, in the closed position of the valve 205*a-b*, the seat 1002 rests on the splayed part of the obturator 1003.

The first 218*a* and the second valve 218*b* each have a seat 1006 and an obturator 1008. The obturator 1008 has a splayed part oriented towards the bottle 102. The obturator 1008 is mounted on a spring 1010 and is able to move vertically between a raised position (FIG. 10) and a lowered position (FIG. 11). The spring 1010 constrains the obturator 1008 in the raised position. The seat 1006 is fixed and, in the closed position of the first 218*a* and second 218*b* valves, the obturator 1008 rests under the seat 1006.

When the bottle 102 approaches the plate 256, the obturators 1003 of the bottle 102 come into contact with the obturators 1008 of the plate 256, and the seats 1002 of the bottle 102 come into contact with the seats 1006 of the plate 256. Because of the mobilities of the various elements, the obturators 1003 of the bottle 102 push the obturators 1008 of the plate 256 and the seats 1006 of the plate 256 push the seats 1002 of the bottle 102 (FIG. 11). These pushes cause the seats 1002 of the bottle 102 to pass to the raised position and the obturators 1008 of the plate 256 to pass to the lowered position, causing the simultaneous opening of the valves 205*a-b* and 218*a-b*.

In the embodiment of the invention presented here, the opening/closing mechanism consists of the obturators 1003 of the bottle 102, the obturators 1008 of the plate 256, the seats 1002 of the bottle 102 and the seats 1006 of the plate 256.

Other embodiments of the opening/closing mechanism may also be suitable. In particular, it would be possible to have valves suited to a quarter-turn attachment system, as is known.

FIG. 12 shows a detail of the filling module 104. To prevent the plate 256 rising under the effect of the return means 256 when the bottle is in the window 714, the filling module 104 has a locking system 1200 that can alternately adopt a locking system that locks the plate 256 in the low position or a released position in which the plate 256 can rejoin the high position.

In the embodiment of the invention presented here, the locking system 1200 comprises a guide 1202 secured to the plate 256 and a hook 1204 having a nose 1205 and secured to the base 704 of the filling module 104.

The guide 1202 has an internal guide 1206 and an external guide 1208 that runs around the internal guide 1206 leaving a space between them in order to produce a groove 1210 in which the nose 1205 moves.

The internal guide 1206 has a first tip 1212 oriented downwards, and then to follow two flanks 1214*a-b* parallel to one another and progressing upwards on either side of the tip 1212, and finally to follow a second point 1216 oriented downwards between the two flanks 1214*a-b*.

In the high position, the nose 1205 is positioned below the first tip 1212 (position A), as the plate 256 lowers, the nose 1205 progresses along the first flank 1214*a* (position B). When the plate 256 reaches the low position, the nose 1205 reaches the top end of the first flank 1214*a* (position C). In releasing the plate 256 and under the effect of the return means 254, the plate 256 rises and the nose 1205 is housed at the bottom of the second tip 1216 (position D). The locking system 1200 is then in the locked position.

To pass to the released position again, the user once again presses on the plate 256, the nose 1205 then moves towards the top end of the second flank 1214*b* (position E) and, after release, the nose 1205 will progress along the second flank 1214*b* (position F), until it rejoins its initial position A.

In order, during its movements, to prevent the nose 1205 moving in the opposite direction to the one described above, in particular from positions E to D, or D to C, or C to B, the bottom of the groove 1210 has:

- a first descending step 1218*a* situated at the junction between the top end of the first flank 1214*a* and the top part of the second tip 1216 (position C),
- a second descending step 1218*b* situated just upstream of the bottom of the second tip 1216 (position D), and
- a third descending step 1218*c* situated at the junction between the top end of the second flank 1214*b* and the top part of the second tip 1216 (position E).

The bottom of the groove 1210 along the second flank 1214*b* then has a continuous ascending slope in order to compensate for the steps 1218*a-c*.

Thus the bottle can be housed in a stable fashion in the filling module in the low position of the plate 256, which gives the whole an appearance of a traditional perfume bottle.

The invention is not limited to the perfume field but applies to any liquid, and also to creams and gels that are very fluid and that may be termed liquids, by means of an adaptation of the caliber of the pipes, in particular to allow free circulation.

The invention claimed is:

1. A filling system comprising:

a bottle having a hollow enclosure with a base pierced with two holes, a filling module comprising:

a reservoir having a bottom, a plate able to be moved in translation vertically between a high position and a low position and having a location for accommodating the base, a pump in the form of a flexible enclosure, a compression system configured so as to compress the pump when the plate passes from the high position to the low position, a return means that constrains the plate in the high position, and a pipe assembly between the reservoir and the plate on one side and between the reservoir and the pump on an other side, and a connection assembly for a fluid between the plate and the base and which comprises:

for each of the two holes, a valve housed in the hole, extended in the bottle by a pipe and able to move between a closed position and an open position, a first valve and a second valve both fixed to the plate, able to move between a closed position and an open position, the first valve being designed to cooperate with one of the valves and the second valve being designed to cooperate with the other valve, the second valve being connected to one of the pipes of said set of pipes, where said pipe assembly comprises:

a first pipe emerging in the reservoir at the bottom, a second pipe emerging in the reservoir at a distance from the bottom and connected to the second valve, a first non-return valve between the first pipe and the pump and allowing a liquid to pass from the first pipe to the pump, a connecting pipe extending the first valve, a second non-return valve between the connecting pipe and the pump, and allowing the liquid to pass from the pump to the connecting pipe, and an opening/closing mechanism configured so as to simultaneously open the valves when the first valve is in contact with one of the valves and the second valve is in contact with the other valve, and to simultaneously close the valves when they are not in contact, and where the filling module comprises a base consists of a platen and a sub-platen fixed to one another and between which part of the second pipe is implemented by means of recesses, where the plate comprises a top plate and an underplate fixed to one another and between which part of the second pipe is implemented by means of recesses, and where the second pipe has an intermediate part that extends between the plate and the base, and where the intermediate part takes the form of a bellows tube, wherein the ends of the two pipes that emerge in the bottle are at the same height in the bottle.

2. The filling system of claim 1, wherein the first pipe emerges in the reservoir so as to be flush with respect to the bottom.

3. The filling system of claim 1, wherein each valve of the bottle has a seat and an obturator, wherein the seat is mounted on a spring and able to move vertically between a lowered position and a raised position, wherein the obturator is fixed and has a splayed part oriented towards the plate, wherein the first and second valves each have a seat and an obturator, wherein the obturator has a splayed part oriented towards the bottle, wherein the obturator is mounted on a spring and is able to move vertically between a raised position and a lowered position, and wherein the seat is fixed.

4. The filling system of claim 1, wherein the return means consists of a compression spring housed in the pump.

5. The filling system of claim 1, wherein the filling module has a casing pierced with a window above the first and second valves, a flap mounted on the casing and able to move between a closed position in which the flap closes off the window and an open position in which the flap does not close off the window, and a return means that constrains the flap in the closed position.

6. The filling system of claim 1, wherein the plate has at least one magnet and in that the base of the bottle has, for the or each magnet, a counter-magnet of opposite polarity.

7. The filling system of claim 1, wherein the filling module has a locking system that can alternately adopt a locking position that locks the plate in the low position or a released position in which the plate can rejoin the high position.

8. A filling system comprising:

a bottle having a hollow enclosure with a base pierced with two holes, a filling module comprising:

a reservoir having a bottom, a plate able to be moved in translation vertically between a high position and a low position and having a location for accommodating the base, a pump in the form of a flexible enclosure, a compression system configured so as to compress the pump when the plate passes from the high position to the low position, a return means that constrains the plate in the high position, and a pipe assembly between the reservoir and the plate on one side and between the reservoir and the pump on the other side, and a connection assembly for a fluid between the plate and the base and which comprises:

for each of the two holes, a valve housed in the hole, extended in the bottle by a pipe and able to move between a closed position and an open position, a first valve and a second valve both fixed to the plate, able to move between a closed position and an open position, the first valve being designed to cooperate with one of the valves and the second valve being designed to cooperate with the other valve, the second valve being connected to one of the pipes of said set of pipes, where said pipe assembly comprises:

a first pipe emerging in the reservoir at the bottom, a second pipe emerging in the reservoir at a distance from the bottom and connected to the second valve, a first non-return valve between the first pipe and the pump and allowing the liquid to pass from the first pipe to the pump, a connecting pipe extending the first valve, a second non-return valve between the connecting pipe and the pump, and allowing the liquid to pass from the pump to the connecting pipe, and an opening/closing mechanism configured so as to simultaneously open the valves when the first valve is in contact with one of the valves and the second valve is in contact with the other valve, and to simultaneously close the valves when they are not in contact, and where the filling module comprises a base consists of a platen and a sub-platen fixed to one another and between which part of the second pipe is implemented by means of recesses, where the plate comprises a top plate and an underplate fixed to one another and between which part of the second pipe is implemented by means of recesses, and where the second pipe has an intermediate part that extends between the plate and the base, and where the intermediate part takes the form of a bellows tube, and wherein the return means consists of a compression spring housed in the pump.

9. A filling system comprising:

a bottle having a hollow enclosure with a base pierced with two holes, a filling module comprising:

a reservoir having a bottom, a plate able to be moved in translation vertically between a high position and a low position and having a location for accommodating the base, a pump in the form of a flexible enclosure, a compression system configured so as to compress the pump when the plate passes from the high position to the low position, a return means that constrains the plate in the high position, and a pipe assembly between the reservoir and the plate on one side and between the reservoir and the pump on the other side, and a connection assembly for a fluid between the plate and the base and which comprises:

for each of the two holes, a valve housed in the hole, extended in the bottle by a pipe and able to move between a closed position and an open position, a first valve and a second valve both fixed to the plate, able to move between a closed position and an open position, the first valve being designed to cooperate with one of the valves and the second valve being designed to cooperate with the other valve, the second valve being connected to one of the pipes of said set of pipes, where said pipe assembly comprises:

a first pipe emerging in the reservoir at the bottom, a second pipe emerging in the reservoir at a distance from the bottom and connected to the second valve, a first non-return valve between the first pipe and the pump and allowing the liquid to pass from the first pipe to the pump, a connecting pipe extending the first valve, a second non-return valve between the connecting pipe and the pump, and allowing the liquid to pass from the pump to the connecting pipe, and an opening/closing mechanism configured so as to simultaneously open the valves when the first valve is in contact with one of the valves and the second valve is in contact with the other valve, and to simultaneously close the valves when they are not in contact, and where the filling module comprises a base consists of a platen and a sub-platen fixed to one another and between which part of the second pipe is implemented by means of recesses, where the plate comprises a top plate and an underplate fixed to one another and between which part of the second pipe is implemented by means of recesses, and where the second pipe has an intermediate part that extends between the plate and the base, and where the intermediate part takes the form of a bellows tube, and wherein the plate has at least one magnet and in that the base of the bottle has, for each magnet, a counter-magnet of opposite polarity.

* * * * *